US012196112B2

(12) United States Patent
Weidauer

(10) Patent No.: US 12,196,112 B2
(45) Date of Patent: Jan. 14, 2025

(54) SLIDING CAM SYSTEM FOR AN INTERNAL COMBUSTION ENGINE, COMPRISING AN INTEGRATED LOCKING ELEMENT

(71) Applicants: thyssenkrupp Dynamic Components GmbH, Ilsenburg (DE); thyssenkrupp AG, Essen (DE)

(72) Inventor: Marcel Weidauer, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 0 days.

(21) Appl. No.: 18/020,854

(22) PCT Filed: Aug. 10, 2021

(86) PCT No.: PCT/EP2021/072303
§ 371 (c)(1),
(2) Date: Feb. 10, 2023

(87) PCT Pub. No.: WO2022/034101
PCT Pub. Date: Feb. 17, 2022

(65) Prior Publication Data

US 2023/0304423 A1 Sep. 28, 2023

(30) Foreign Application Priority Data

Aug. 12, 2020 (DE) ..... 10 2020 210 265.1

(51) Int. Cl.
*F01L 1/047* (2006.01)
*F01L 1/053* (2006.01)
*F01L 13/00* (2006.01)

(52) U.S. Cl.
CPC ..... *F01L 1/047* (2013.01); *F01L 1/053* (2013.01); *F01L 2001/0473* (2013.01); *F01L 2013/0052* (2013.01)

(58) Field of Classification Search
CPC ..... F01L 1/047; F01L 2001/0473; F01L 2013/0052; F01L 1/053; F01L 13/0036
See application file for complete search history.

(56) References Cited

U.S. PATENT DOCUMENTS 8,960,143 B2 2/2015 Meintschel et al.
9,249,697 B2 2/2016 Doller
(Continued)

FOREIGN PATENT DOCUMENTS

DE 102007010154 A1 * 6/2008 ..... F01L 1/053
DE 102007010157 A1 * 6/2008 ..... F01L 1/047
(Continued)

OTHER PUBLICATIONS

DE-102011054218-A1, English Language Machine Translation (Year: 2013).*
(Continued)

*Primary Examiner* — Wesley G Harris
(74) *Attorney, Agent, or Firm* — thyssenkrupp North America, LLC

(57) ABSTRACT

The present invention concerns a sliding cam system for an internal combustion engine having at least one camshaft, an adjustment element and at least one actuator. The camshaft comprises a carrier shaft with a primary sliding cam element and at least one secondary sliding cam element. Each of the cam elements are arranged so as to be displaceable axially relative to the carrier shaft. Each of the cam elements comprises a shift gate with at least one shift groove. The actuator has at least one actuator pin which engages in the shift groove of the shift gate of the primary sliding cam element according to the necessary switch position of the camshaft. The adjustment element is arranged parallel to a longitudinal axis of the carrier shaft and is axially displace-
(Continued)

able in the direction of the longitudinal axis of the carrier shaft and has at least two coupling pins.

17 Claims, 5 Drawing Sheets

(56) References Cited

U.S. PATENT DOCUMENTS

| | | | | |
|---|---|---|---|---|
| 10,260,380 | B2 | 4/2019 | Schmidt et al. | |
| 2015/0330270 | A1* | 11/2015 | Noda | F01L 13/0036 123/90.2 |
| 2017/0321575 | A1 | 11/2017 | Wetzel | |

FOREIGN PATENT DOCUMENTS

| | | | | |
|---|---|---|---|---|
| DE | 10 2007 010 149 | A1 | 9/2008 | |
| DE | 102007010148 | A1 * | 9/2008 | F01L 1/047 |
| DE | 102007037747 | A1 | 2/2009 | |
| DE | 102007052249 | A1 | 5/2009 | |
| DE | 102008005639 | A1 | 7/2009 | |
| DE | 102008050776 | A1 | 4/2010 | |
| DE | 102008060166 | A1 | 6/2010 | |
| DE | 102010004591 | A1 | 7/2011 | |
| DE | 102010021903 | A1 | 12/2011 | |
| DE | 102011001123 | A1 | 9/2012 | |
| DE | 102011001288 | A1 | 9/2012 | |
| DE | 102011002141 | A1 | 10/2012 | |
| DE | 102011078434 | A1 | 1/2013 | |
| DE | 102011053333 | A1 | 3/2013 | |
| DE | 102011054218 | A1 * | 4/2013 | F01L 1/053 |
| DE | 102011116653 | A1 | 4/2013 | |
| DE | 102011085702 | A1 | 5/2013 | |
| DE | 102012022123 | A1 | 5/2013 | |
| DE | 102011121684 | A1 | 6/2013 | |
| DE | 102012022208 | A1 | 6/2013 | |
| DE | 102012008555 | B4 | 10/2013 | |
| DE | 102012209860 | A1 * | 12/2013 | F01L 13/0036 |
| DE | 102012112795 | A1 | 6/2014 | |
| DE | 102013009757 | A1 | 12/2014 | |
| DE | 10 2013 221 251 | A1 | 4/2015 | |
| DE | 102013111410 | A1 | 4/2015 | |
| DE | 102013113348 | A1 | 6/2015 | |
| DE | 102013113349 | | 6/2015 | |
| DE | 102014007189 | A1 | 11/2015 | |
| DE | 102014216058 | A1 | 2/2016 | |
| DE | 102015220602 | A1 | 4/2017 | |
| DE | 102016015279 | A1 * | 7/2017 | |
| DE | 102016204892 | A1 | 9/2017 | |
| DE | 102016005454 | A1 | 11/2017 | |
| DE | 102016207503 | A1 * | 11/2017 | |
| DE | 102017210281 | A1 * | 12/2017 | F01L 1/047 |
| DE | 102018111942 | A1 | 11/2019 | |
| DE | 102018112414 | A1 | 11/2019 | |
| DE | 102018112415 | A1 | 11/2019 | |
| DE | 102018112416 | A1 | 11/2019 | |
| DE | 102018112417 | A1 | 11/2019 | |
| DE | 102018112419 | A1 | 11/2019 | |
| DE | 102019102103 | A1 | 11/2019 | |
| DE | 10 2019 107 626 | A1 | 10/2020 | |
| EP | 2132418 | B1 | 12/2009 | |
| EP | 2 181 251 | B1 | 5/2010 | |
| EP | 2 331 795 | B1 | 6/2011 | |
| EP | 2585687 | B1 | 5/2013 | |
| EP | 2676015 | B1 | 12/2013 | |
| EP | 2823159 | B1 | 1/2015 | |
| EP | 2 859 199 | B1 | 4/2015 | |
| EP | 3365537 | B1 | 8/2018 | |
| JP | 2012-505 333 | A | 3/2012 | |
| WO | 2016177479 | A1 | 11/2016 | |
| WO | 2017/067549 | A1 | 4/2017 | |
| WO | 2018195370 | A1 | 10/2018 | |

OTHER PUBLICATIONS

DE-102012209860-A1, English Language Machine Translation (Year: 2013).*

DE-102007010148-A1, English Language Machine Translation (Year: 2008).*

DE-102016015279-A1, English Language Machine Translation (Year: 2017).*

English Translation of International Search Report issued in PCT/EP2021/072303, dated Nov. 19, 2021.

* cited by examiner

SLIDING CAM SYSTEM FOR AN INTERNAL COMBUSTION ENGINE, COMPRISING AN INTEGRATED LOCKING ELEMENT

CROSS REFERENCE TO RELATED APPLICATIONS

This application is a U.S. National Stage Entry of International Patent Application Serial Number PCT/EP2021/072303, filed Aug. 10, 2021, which claims priority to German Patent Application No. DE 10 2020 210 265.1, filed Aug. 12, 2020, the entire contents of which are incorporated herein by reference.

FIELD

The present disclosure generally relates to a sliding cam system for an internal combustion engine.

BACKGROUND

A sliding cam system is known for example from DPMA application 10 2019 107 626.9 and the parallel application PCT/EP2020/058182, which with respect to their descriptions are made part of the content of this application, so that the features listed therein also constitute features of the present application. The above-mentioned applications, which are internal prior art and not yet published, each disclose a sliding cam system for an internal combustion engine with at least one camshaft comprising a carrier shaft with at least two sliding cam elements. The sliding cam elements each comprise a shift gate with at least one shift groove, wherein the sliding cam elements are displaceable axially relative to the carrier shaft by means of at least one actuator pin.

At least one adjustment element is arranged parallel to a longitudinal axis of the carrier shaft, wherein the adjustment element is axially displaceable in the direction of the longitudinal axis of the carrier shaft. In other words, the adjustment element is axially displaceable along the longitudinal axis of the carrier shaft. The adjustment element has at least two coupling pins, wherein a first coupling pin is arranged in the region of the first sliding cam element and a second coupling pin is arranged in the region of the second sliding cam element. The coupling pins each cooperate with a shift gate of the respective associated sliding cam element such that the adjustment element can transmit a movement of the first sliding cam element, initiated by the actuator pin, to the second sliding cam element. Accordingly, the sliding cam system allows the transmission of an axial movement of a conventionally switched sliding cam element to at least one further sliding cam element. Conventionally switched here means that the axial movement is initiated by an actuator, in particular an actuator pin. The adjustment element comprises at least one receiving element in the form of at least one protrusion, and the carrier shaft has at least one locking element in the form of a circular disc, which cooperate with one another in operation such that the adjustment element is locked between two position changes. Accordingly, the locking element forms an abutment for the receiving element.

Thus a need exists to simplify the above-described sliding cam system, in particular to reduce its production costs and advantageously also extend its service life. In particular, a need also exists to provide a sliding cam system in which, in a simple and economic fashion, the production costs, in particular of the pushrods and advantageously the entire sliding cam system, are minimized, and the restrictions concerning the existing axial installation space on the camshaft are taken into account, and accordingly, advantageously, there is a reduction in the number of components with at least equal and advantageously optimized function.

DETAILED DESCRIPTION

Figure 1:
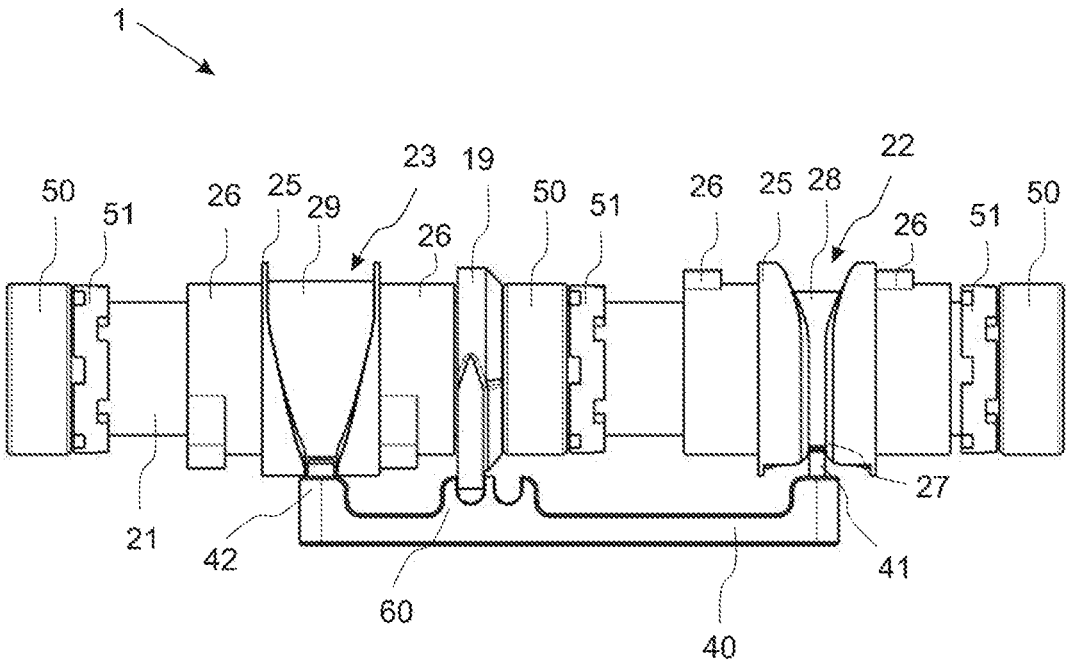
Fig. 1 (Prior art)
FIG. 1 is a side view, an embodiment of a sliding cam system known from the cited prior art.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The sliding cam system according to the invention for an internal combustion engine has at least one camshaft, an adjustment element and at least one actuator. The camshaft comprises a carrier shaft with a primary sliding cam element and at least one secondary sliding cam element, each of which is arranged so as to be displaceable axially relative to the carrier shaft and each comprises a shift gate with at least one shift groove. The actuator has at least one actuator pin which engages in the shift groove of the shift gate of the primary sliding cam element according to the necessary switch position of the camshaft. Here, it is conceivable that the shift groove of the shift gate has an X shape. It is however also conceivable that the actuator comprises a plurality of actuator pins, in particular two or three actuator pins, which then engage in the shift groove of the shift gate according to the necessary switch position of the camshaft. Here it is conceivable that the shift groove of the shift gate has a Y shape or a V shape. The adjustment element is arranged parallel to a longitudinal axis of the carrier shaft and is axially displaceable in the direction of the longitudinal axis of the carrier shaft and has at least two coupling pins, wherein a first coupling pin is arranged in the region of the primary sliding cam element and a second coupling pin is arranged in the region of the secondary sliding cam element. The coupling pins themselves may take the form of a pin (cylindrical), a protrusion, an extension, a lug or a comparable form which allows the engagement in a groove, in particular a shift groove of a sliding cam element. It is conceivable that all coupling pins of the adjustment element have an identical form. Alternatively, it is conceivable that at least two of the coupling pins or each coupling pin of the adjustment element have/has a different design. Advantageously, the coupling pins extend orthogonally from a rod element of the adjustment element, which extends in the longitudinal direction of the camshaft, in particular the carrier shaft of the camshaft, in the direction away from this camshaft. The coupling pins are here either molded on the rod element or formed as part of the rod element and accordingly formed or shaped from this. According to the invention, the coupling pins each cooperate with a shift gate of the respective associated sliding cam element, such that the adjustment element transmits a movement of the primary sliding cam element initiated by the actuator pin to the secondary sliding cam element. According to the invention, a locking element on the primary sliding cam element is configured at least for locking the adjustment element between at least two position changes such that the locking element is displaceable axially along the longitudinal axis of the carrier shaft. Furthermore, at least one abutment element is formed in contact with the locking element and configured to be non-displaceable and rotationally fixed relative to and radially spaced from the carrier shaft at least for receiving the axial forces transmitted by the locking element. The advantage is that the adjustment element is locked and the sliding cam element does not execute any unwanted movements, for example triggered by impacts or vibrations. It is also conceivable that more than one abutment element, in particular two abutment elements, is/are provided.

The second coupling pin is arranged on the adjustment element offset from the first coupling pin in the axial direction of the carrier shaft. The second coupling pin cooperates with a secondary sliding cam element. More precisely, the second coupling pin engages in a shift groove of the shift gate of the secondary sliding cam element. Because of the axial movement of the adjustment element, which is advantageously configured as a pushrod, the second coupling pin is arranged on a flank of the shift groove of the secondary sliding cam element. The second coupling pin loads the flank of the shift groove of the secondary sliding cam element with a force which moves the secondary sliding cam element axially, corresponding to the movement of the primary sliding cam element. It is conceivable that the adjustment element comprises several coupling pins which cooperate with further sliding cam elements, in particular secondary sliding cam elements. The advantage of the sliding cam system according to the invention is that the adjustment element has a simple and compact structure. Since the coupling pins of the adjustment element engage in the gates of the sliding cam elements, the adjustment element may be arranged close to the carrier shaft, wherein the camshaft takes up less installation space. The adjustment element, in particular the rod element of the adjustment element, is arranged parallel to a longitudinal axis of the carrier shaft. Thus a movement in the axial direction of the carrier shaft can easily be achieved. It is conceivable that, for this, the adjustment element is arranged on a rail.

In one embodiment, the at least one abutment element is or may be formed directly or indirectly on a cylinder head cover or cylinder head, in particular a bearing bridge of the cylinder head for mounting the camshaft. Advantageously, the abutment element then extends in the direction of the camshaft, starting from a rigid component which is in particular immovable relative to the camshaft. Accordingly, the abutment element is also formed immovable, in particular rotationally fixed and translationally fixed relative to the camshaft which rotates/turns about its longitudinal axis and the locking element formed on the camshaft, in particular on its primary sliding cam element. The abutment element is accordingly an element arranged fixedly on the housing, in particular when mounted or formed on the cylinder head cover.

In an alternative embodiment, the abutment element is formed on the actuator. Thus, advantageously, the use of a further component for arranging the abutment element on the far side of the actuator is avoided. This again reduces the production costs of the sliding cam system and the possible maintenance costs.

When the abutment element is formed on the actuator, it is conceivable that the abutment element is formed on the actuator axially next to the at least one actuator pin or, if the actuator is designed with two actuator pins, between the at least two actuator pins, in particular in the form of a protrusion. Axially next to the actuator here means that, in the longitudinal direction of the carrier shaft to which the actuator is aligned, the at least one actuator pin and abutment element are formed next to one another, i.e. directly adjacent to one another. If the actuator has more than two actuator pins, in particular three actuator pins, advantageously two abutment elements are arranged between the respective actuator pins so that in the longitudinal direction (axial) of the carrier shaft, the following arrangement results: actuator pin—first abutment element—actuator pin—second abutment element—actuator pin. The at least one abutment element accordingly extends, starting from the distal end of the actuator dome, running parallel to the at least one actuator, in the direction of the camshaft, in particular in the direction of the locking element. Thus taking into account the space available in the region of the actuator dome while simultaneously observing the full function scope of the actuator, an optimum arrangement of the at least one abutment element is possible. This means that the at least one actuator pin available on the actuator can, despite the arrangement and design of the abutment element, engage reliably in the shift groove provided for this in order to allow a displacement of the primary sliding cam element. The same also applies to the design of several actuator pins and/or multiple abutment elements.

It is conceivable to provide a multiple actuator with at least two actuator pins, in particular at least three actuator pins, via which the sliding cam elements are movable into at least two, in particular three axial positions in order to allow different switch positions, in particular for a two-stage, three-stage or multistage timing control system for the valves. The two actuator pins of the multiple actuator can move the sliding cam elements, coupled together by the adjustment element, between a total of two axial positions. In this embodiment, the at least one cam portion of the respective sliding cam element preferably has a lift cam contour and a zero-lift cam contour, or two lift cam contours with different lift heights. The combination of the multiple actuator with two actuator pins, and of the cam portion with two contours, allows a two-stage timing control of the valve assigned to the cam portion. In a variant with three actuator pins of the multiple actuator, the sliding cam elements coupled together by the adjustment element can be moved between a total of three axial positions. In this embodiment, the at least one cam portion of the respective sliding cam element preferably has two lift cam contours with different lift heights and one zero-lift cam contour, or a total of three lift cam contours with different lift heights. The combination of the multiple actuator with three actuator pins, and the cam portion with a total of three contours, allows a three-stage timing control of the valve assigned to the cam portion.

In a further embodiment, it is conceivable that the locking element is formed in the shift groove of the shift gate of the primary sliding cam element in the form of a circular disc or ring disc having a cutout, in particular in the form of a half-circle disc or part-circular disc. The length of the locking element extending in the peripheral direction of the shift groove is substantially also dependent on the design the shift groove and accordingly the length of the shift groove. In particular, the locking element in the form of a protrusion, an elevation or a projection extends at least in portions radially from the surface of the shift groove. The locking element extends at least in portions in the circumferential direction inside the shift groove. Accordingly, the shift groove has a portion in which no locking element is formed. This portion without locking element, which accordingly also corresponds to the region of the cutout/opening, allows a displacement of the primary sliding cam element on engagement of at least one actuator pin in the shift groove provided for this. This means that along this portion without locking element, the abutment element—which otherwise is in contact with the locking element or, viewed in the longitudinal direction relative to the carrier shaft, rests on this locking element-creeps or shifts from one side of the locking element to its other side because of the displacement of the primary sliding cam element in the axial direction along the longitudinal axis of the carrier shaft.

In one embodiment, the at least one actuator pin, in particular the actuator, and the at least two coupling pins, in particular the adjustment element, are offset in a circumferential direction of the carrier shaft, in particular by 90°. Alternatively, other angular offsets are conceivable, such as for example more than 90° or less than 90°.

In one embodiment, the shift gate of the primary sliding cam element comprises at least one first shift groove for receiving the at least one actuator pin and at least one second shift groove for receiving the first coupling pin, wherein the locking element is formed in the first shift groove. To move the first sliding cam element in an axial direction, the actuator pin engages in the first shift groove of the shift gate of the first sliding cam element. The actuator pin is not movable in the axial direction of the carrier shaft. The actuator pin is guided in portions in the first shift groove and delimited by at least one flank of the shift groove. The sliding cam element is displaceable in an axial direction by the course of the shift groove. The actuator pin is arranged in the shift groove only during the displacement process.

According to one embodiment, the first shift groove of the primary sliding cam element has at least in portions an X-shaped, V-shaped or Y-shaped profile. In particular, the first shift groove at least in portions has an X-shaped profile when an actuator with only a single actuator pin is used to switch the primary sliding cam element. Advantageously, accordingly, this first shift groove at least in portions has a V-shaped or Y-shaped profile when an actuator with at least two actuator pins is used to switch the primary sliding cam element. Thus it is possible that the primary sliding cam element comprises a second shift groove for the first coupling pin which is arranged such that the adjustment element can be displaced directly. It is furthermore conceivable that the first shift groove of the primary sliding cam element has regions with different radii, each of which is assigned to a region of the primary sliding cam element, in particular an inlet region, a displacement region and an outlet region. This leads to a gentle entry and exit of the at least one actuator pin, in particular the actuator pin to be currently brought into engagement, and a substantially smooth displacement of the primary sliding cam element.

It is also conceivable that the second shift groove of the primary sliding cam element is formed next to the first shift groove, in particular at an axial end of the primary sliding cam element next to the first shift groove, as a groove extending over the entire periphery of the primary sliding cam element, in particular a ring groove, with a constant radius, wherein the first coupling pin is permanently arranged in said second shift groove such that an axial displacement of the primary sliding cam element can be transmitted directly to the adjustment element. More precisely, thus it is possible that a temporally offset or phase-shifted axial movement of the at least one secondary sliding cam element is dependent solely on the shift gate of the at least one secondary sliding cam element. Advantageously, the first coupling pin is permanently arranged in the second shift groove. On a displacement of the primary sliding cam element, the first coupling pin cooperates with the second shift groove such that the axial movement of the primary sliding cam element is transmitted to the adjustment element.

It is conceivable that the shift gate of the secondary sliding cam element at least in portions has a V-shaped profile. The V-shaped profile is easy to produce, for example by milling. Advantageously, in an embodiment of more than one secondary sliding cam element, all secondary sliding cam elements at least in portions have a V-shaped profile, wherein the V-shaped profiles each have a constant radius. The V-shaped profiles with constant radius are advantageous since no inlet or outlet tracks are necessary in the secondary sliding cam elements.

Advantageously, the carrier shaft comprises at least a third, in particular at least a fourth secondary sliding cam element. In this way, the sliding cam system can be used in larger internal combustion engines. It is conceivable that the sliding cam system comprises several camshafts.

According to a further embodiment, the shift grooves of the primary sliding cam element and the at least one secondary sliding cam element are arranged offset to one another at a rotary angle such that the at least one secondary sliding cam element can be displaced in a longitudinal direction of the carrier shaft with a time offset relative to the primary sliding cam element. It is also conceivable that the shift grooves of the primary sliding cam element and the first and second secondary sliding cam elements are arranged offset to one another at a rotary angle. The temporally offset displacement of the secondary sliding cam element allows a temporally offset influencing of the valve timing, in particular an activation and/or deactivation of the valves of a cylinder of an internal combustion engine.

It is furthermore possible that the sliding cam elements, in particular the primary sliding cam element and the at least one secondary sliding cam element, are formed as a double sliding cam element, wherein each of the double sliding cam elements is configured to control the valves of two cylinders.

Valve cams, in particular cam portions with one or more cam contours, of a single cylinder and also valve cams, in particular cam portions with one or more cam contours, of several adjacent cylinders may be arranged on the respective sliding cam elements, i.e. the primary sliding cam element and the at least one secondary sliding cam element. The valve cams of the respective sliding cam element may have different valve lift heights. For example, double sliding cam elements may be used which comprise valve cams of two adjacent cylinders. In other words, the double sliding cam elements may be configured to actuate valves of two adjacent, in particular separate cylinders. Here, the camshaft may have precisely two double sliding cam elements, wherein each double sliding cam element during operation controls at least one valve of two adjacent cylinders. Such camshafts may be used in four-cylinder variants of internal combustion engines. Alternatively, the sliding cam elements may be configured to control at least one valve of a single cylinder. Here, the camshaft may have precisely three sliding cam elements. Such camshafts may be used in three-cylinder variants of internal combustion engines. For example, a design with three double sliding cam elements is also conceivable.

In general, valve cams for associated inlet valves and/or associated exhaust valves may be arranged on at least one of the sliding cam elements or double sliding cam elements, i.e. the primary sliding cam element and the at least one secondary sliding cam element. The combination of valve cams for associated inlet valves and exhaust valves on the sliding cam element(s) or double sliding cam element(s) may be used for internal combustion engines with only one camshaft. These camshafts may for example be used as single overhead camshafts (SOHC) in internal combustion engines.

Preferably, the respective cam portion has at least two lift cam contours, in particular at least three lift cam contours, for actuating the valve, wherein the lift cam contours each comprise different lift heights. Thus the associated valve may be operated in two switch stages. In other words, on axial displacement of the sliding cam element, the associated valve may be actuated with two different lift heights. In a further variant, the respective cam portion may have at least three lift cam contours with different lift heights. Thus the associated valve may be operated in a total of three switch stages. On axial displacement of the sliding cam element, the associated valve may thus be set to three different lift heights. The described multistage control of a valve of a cylinder allows increased variability in the timing control of the valve and hence the internal combustion engine. For example, the change between different operating modes of the internal combustion engine, e.g. full-load operation, part-load operation, can thereby be made.

It is furthermore conceivable that the cam portion also has at least one zero-lift cam contour for shutting down the cylinder assigned to the valve, wherein the zero-lift cam contour adjoins a/the lift cam contour. The cam portion may comprise a lift cam contour and an adjacent zero-lift cam contour. An axial displacement of the corresponding sliding cam element, i.e. the primary sliding cam element or secondary sliding cam element, causes a switch between the lift cam contour or zero-lift cam contour. This corresponds to a two-stage control of the valve. Alternatively, the cam portion may have two lift cam contours with different lift heights and an adjacent zero-lift cam contour. An axial displacement of the corresponding sliding cam element causes a switch between the two lift cam contours or between one of the two lift contours and the zero-lift cam contour. This corresponds to a three-stage control of the valve. Further combinations of several lift cam contours and at least one zero-lift cam contour are possible.

In the context of the invention, the lift cam contour corresponds to a contour which, during operation, causes a lift of the associated valve, or serves as a pump cam for actuating the injection pump, or as a brake cam in the truck sector. The lift cam contour is part of a lift cam or adjustment cam. The zero-lift cam contour causes no lift of the associated valve. The zero-lift cam contour is part of a zero-lift cam. The zero-lift cam contour is preferably circular, in particular cylindrical. The zero-lift cam contour advantageously serves for cylinder shut-down.

In a further embodiment, the primary sliding cam element and the (multiple) actuator are arranged in a first axial region of the carrier shaft, and the first secondary sliding cam element and/or the second secondary sliding cam element is/are arranged in a second axial region of the carrier shaft adjacent to the first axial region. In a further embodiment, the primary sliding cam element and the actuator are arranged between the first and the second secondary sliding cam element, in particular centrally, in the longitudinal direction of the carrier shaft, and the first and/or second secondary sliding cam element is/are arranged in a second axial region of the carrier shaft adjacent to the first axial region. The different arrangements of the sliding cam elements and actuator allows the sliding cam system to be variably adaptable to the respective installation conditions and tolerances.

Furthermore, an internal combustion engine is disclosed, in particular a motor, having at least one sliding cam system of the above-described type. The internal combustion engine may here be used in various vehicles.

It is understood that the above-mentioned features and those to be explained below may be used not only in the respective combination given but also in other combinations or alone without leaving the scope of the present invention.

Elements with the same function and working method carry the same reference sign in FIGS. 1 to 11.

Figure 2:
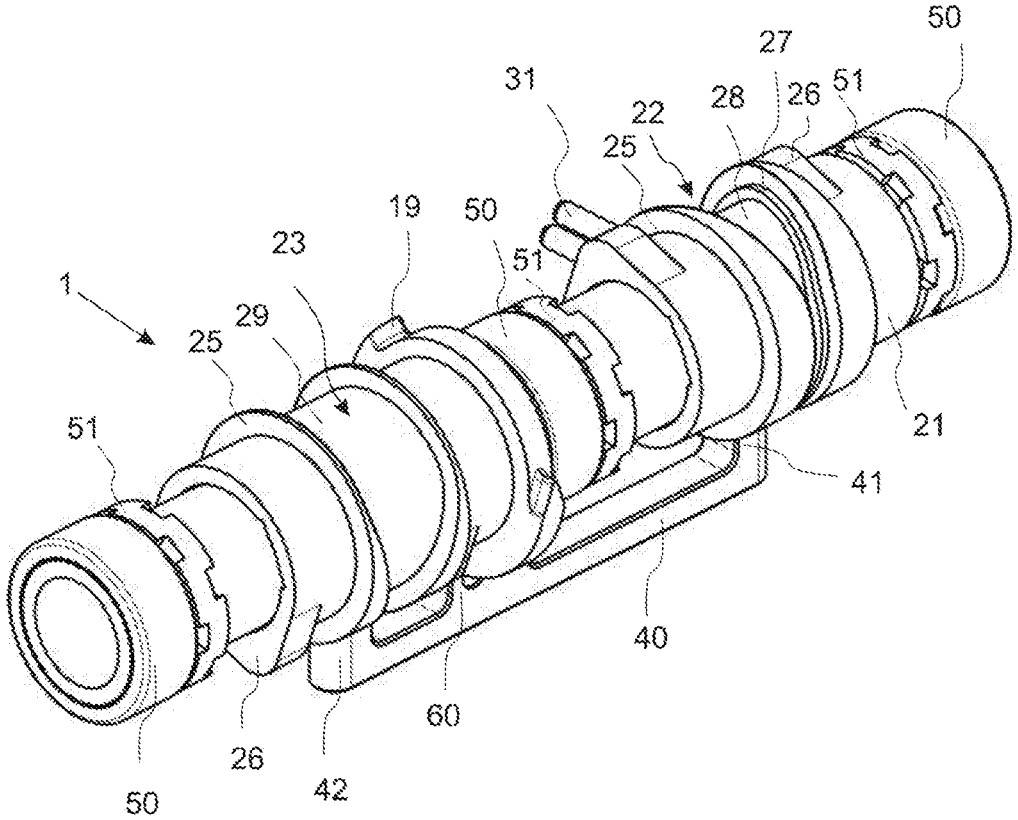
Fig. 2 (Prior art)
FIG. 2 is a perspective view, the sliding cam system shown in FIG. 1.

FIGS. 1 and 2 show an embodiment of a sliding cam system 1 known from the cited prior art.

The sliding cam system 1 comprises a carrier shaft 21. A first sliding cam element, in particular a primary sliding cam element 22, and a second sliding cam element, in particular a secondary sliding cam element 23, are arranged on the carrier shaft 21 so as to be axially movable relative to a longitudinal axis of the carrier shaft 21. It is conceivable that more than two secondary sliding cam elements 23 are arranged on the carrier shaft 21. The carrier shaft 21 comprises three roller bearings 50. A roller bearing 50 is arranged at each axial end of the carrier shaft 21, and a further roller bearing 50 is arranged between the sliding cam elements 22, 23. The roller bearings 50 are locked by retaining rings 51. The number of roller bearings 50 and retaining rings 51, and the positions of the bearing points, are variable. The sliding cam elements 22, 23 comprise a shift gate 25 and a cam portion 26. The shift gate 25 of the primary sliding cam element 22 has a first shift groove 27 and a second shift groove 28. The shift grooves 27, 28 at least in portions are V-shaped. In other words, the width of the two shift grooves 27, 28 is not constant. The width means the spacing of the flanks of the shift grooves 27, 28 in the axial direction relative to the carrier shaft 21. The flanks of the shift grooves 27, 28 approach one another in the V-shaped portion. The two shift grooves 27, 28 are arranged at the same rotary angle or are formed with the same rotary angle. The first shift groove 27 has a greater radius than the second shift groove 28. A radius here means the distance of the groove base surface of the first or second shift groove 27, 28 from the central longitudinal axis of the carrier shaft 21. Thus the outer diameter of the shift gate 25 and the radius of the groove base surface determine the groove depth. The first shift groove 27 comprises a step. In other words, the first shift groove 27 is formed as a protrusion or shoulder. The first shift groove 27 has a varying radius. This means that the first shift groove 27 in portions has regions with a greater radius and a smaller radius. The change in radius is stepless. The regions are respectively assigned to an inlet region, an outlet region or a displacement region. The second shift groove 28 has a constant radius. The width of the second shift groove 28 is smaller than the width of the first shift groove 27.

Two actuator pins 31 are arranged on the carrier shaft 21, or extend from an actuator towards the carrier shaft 21. The actuator pins 31 are movable substantially only in one direction, orthogonally to the center longitudinal axis of the carrier shaft 21. The actuator pins 31 are assigned to the first shift groove 27. This means that the actuator pins only cooperate with the first shift groove 27. The actuator pins 31 are spaced apart from one another in the axial direction of the carrier shaft 21. Thus one of the two actuator pins 31 can be introduced into the first shift groove 27 of the primary sliding cam element 22, depending on the position of the primary sliding cam element 22. By introduction of the actuator pin 31, an axial movement of the primary sliding cam element 22 can be initiated.

For this, an actuator pin 31 is introduced into the first shift groove 27. Because of the reduction in groove width, the inserted actuator pin 31 cooperates with a flank of the first shift groove 27 of the primary sliding cam element 22. More precisely, the inserted actuator pin 31 loads a flank of the first shift groove 27 with a force directed against the flank. This causes the axial displacement of the primary sliding cam element 22. The direction of the displacement thus depends on the flank with which the inserted actuator pin 31 cooperates. An actuator pin 31 is assigned to each flank of the first shift groove 27. An adjustment element 40 is arranged parallel to the carrier shaft 21. The adjustment element 40, which may also be called a pushrod, is axially movable. The adjustment element is offset to the actuator pin 31 by 90°. Alternatively, other angular offsets are conceivable. The adjustment element 40 comprises a first coupling pin 41, a second coupling pin 42 and a receiving element 60. The first and second coupling pins 41, 42 are each arranged at an axial end of the adjustment element 40. The receiving element 60 comprises three protrusions and is arranged between the axial ends of the adjustment element 40. The coupling pins 41, 42 and the receiving element 60 extend orthogonally to the center longitudinal axis of the carrier shaft 21. The first coupling pin 41 is assigned to the second shift groove 28 of the primary sliding cam element 22. The first and second coupling pins 41, 42 are arranged substantially rotatably on the adjustment element 40. The first coupling pin 41 is permanently in engagement with the second shift groove 28 of the first sliding cam element 22.

The first coupling pin 41 is loaded with a force by a flank of the second shift groove 28. The adjustment element 40 is moved in the action direction of the force. Since the adjustment element 40 and hence the coupling pins 41, 42 are offset to one another by 90° in the circumferential direction, and the first and second shift grooves 27, 28 are arranged at the same rotary angle, the displacement of the adjustment element 40 is temporally offset or phase-shifted accordingly.

The second coupling pin 42 is arranged in the region of the secondary sliding cam element 23. The secondary sliding cam element 23 comprises a shift groove 29. The shift groove 29 has a V-shaped portion. The second coupling pin 42 is permanently engaged with the shift groove 29. The shift groove 29 of the secondary sliding cam element 23 is arranged such that the second sliding cam element 23 can be switched with a time offset relative to the first sliding cam element 22.

The displacement of the adjustment element 40 causes the second coupling pin 42 to move axially in the shift groove 29. More precisely, the second coupling pin 42 is moved towards one of the flanks of the shift groove 29. The second coupling pin 42 cooperates with the shift groove 29 substantially in the same way as the actuator pin 31 cooperates with the first shift groove 27 of the primary sliding cam element 22.

The carrier shaft 21 comprises a locking element 19 of circular disc shape. Alternatively, other geometries are conceivable. The locking element 19 is arranged between the primary sliding cam element 22 and the secondary sliding cam element 23. The locking element 19 is axially delimited by the receiving element 60. The locking element 19 has a supporting function. The locking element 19 forms an abutment for the receiving element 60. The locking element 19 absorbs the forces during the shift process and thus allows fixing of the adjustment element 40. Furthermore, the cooperation of the receiving element 60 and the locking element 19 prevents the primary sliding cam element 22 from being undesirably displaced. The receiving element 60 comprises two receivers for the locking element 19. The locking element 19 comprises a cutout. Thus the adjustment element 40 can be moved through the circular disc. For this, the cutout is arranged in the region of the corresponding rotary angle. The cutout is arranged in the circular disc so that on an axial movement, the adjustment element 40 is moved through the cutout. It is conceivable that the adjustment element 40 also has a spring-ball lock (not shown).

Figure 3:
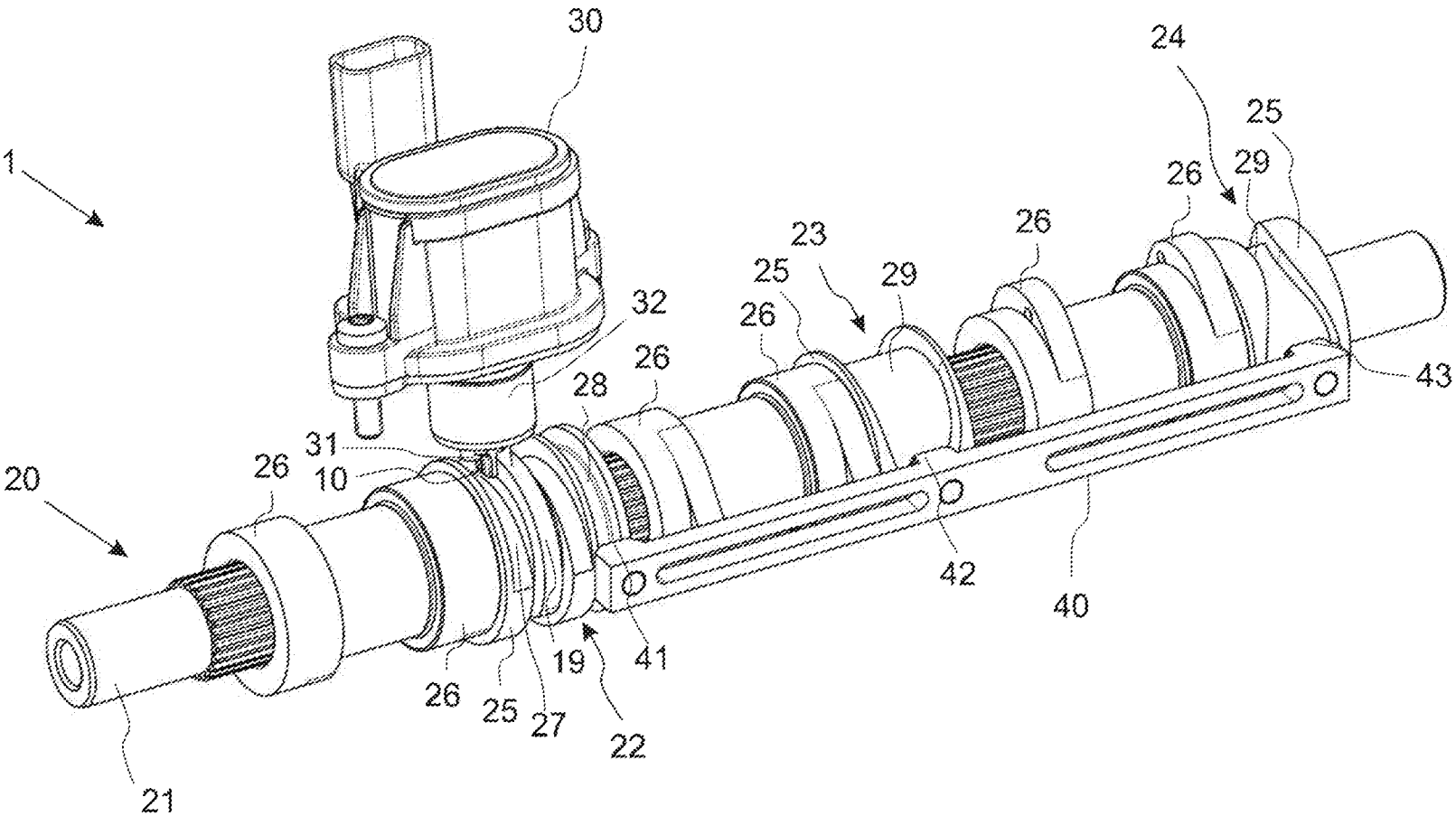
FIG. 3 is a perspective view, an embodiment of a sliding cam system according to the invention.

FIG. 3 shows a perspective view of an embodiment of a sliding cam system 1 according to the invention which corresponds substantially, at least with respect to the function method of the sliding cams 22, 23, 24, actuator 30 and adjustment element 40, to the sliding cam system shown in FIGS. 1 and 2, so the features listed there also apply to the sliding cam system 1 illustrated in FIG. 3. The embodiment of a sliding cam system 1 shown in FIG. 3 also comprises a camshaft 20 with a carrier shaft 21 and sliding cam elements arranged on the carrier shaft 21, in particular a primary sliding cam element 22 and two secondary sliding cam elements 23, 24 which are each arranged so as to be axially movable relative to a longitudinal axis of the carrier shaft 21. The sliding cam elements 22, 23, 24 each comprise a shift gate 25 and a cam portion 26. The shift gate 25 of the primary sliding cam element 22 has a first shift groove 27 and a second shift groove 28. The first shift groove 27 at least in portions is X-shaped, V-shaped or Y-shaped. The width of the first shift groove 27 is not constant. The width means the spacing of the flanks of the first shift groove 27 in the axial direction relative to the carrier shaft 21. The flanks of the first shift groove 27 approach one another in the V-shaped or Y-shaped portion. The width of the second shift groove 28 is constant. The first shift groove 27 has in portions a greater radius than the second shift groove 28. The radius is the distance of the groove base surface of the first or second shift groove 27, 28 from the center longitudinal axis of the carrier shaft 21. Thus the outer diameter of the shift gate 27 and the radius of the groove base surface determine the groove depth. The first shift groove 27 has a varying radius. This means that the first shift groove 27 has in portions regions with a greater radius and a smaller radius. The change in radius is stepless. The regions are each assigned to an inlet region, an outlet region or a displacement region. The second shift groove 28 has a constant radius. The width of the second shift groove 28 is smaller than the width of the first shift groove 27. A locking element 19 is formed between the legs of the X-shaped or V-shaped or Y-shaped portion of the first shift groove 27. This locking element 19 consequently separates the legs of the X-shaped or V-shaped or Y-shaped first shift groove 27 from one another, such that this locking element 19 is formed in the leg region of the X-shaped or V-shaped or Y-shaped first shift groove 27 in which the legs are spaced apart from one another. In the region in which the legs of the X-shaped or V-shaped or Y-shaped first shift groove 27 come together, the locking element 19, extending at least in portions in the circumferential direction, is interrupted. This design is illustrated further for example in FIGS. 5 and 6.

The actuator 30 shown in FIG. 3 has two actuator pins 31 which are arranged on the carrier shaft 21 or extend from the actuator 30 towards the carrier shaft 21. The actuator pins 31 are movable substantially only in one direction, orthogonally to the center longitudinal axis of the carrier shaft 21. The actuator pins 31 are assigned to the first shift groove 27. This means that the actuator pins 31 cooperate only with the first shift groove 27. The actuator pins 31 are spaced apart from one another in the axial direction of the carrier shaft 21. Therefore, depending on the position of the primary sliding cam element 22, one of the two actuator pins 31 can be introduced into the first shift groove 27 of the primary sliding cam element 22 or is in engagement with the first shift groove 27. An axial movement of the primary sliding cam element 22 can be initiated by the insertion of the actuator pins 31.

For this, an actuator pin 31 is introduced into the first shift groove 27. Because of the reduction in groove width, the inserted actuator pin 31 cooperates with a flank of the first shift groove 27 of the primary sliding cam element 22. More precisely, the inserted actuator pin 31 loads a flank of the first shift groove 27 with a force directed against the flank. This causes the axial displacement of the primary sliding cam element 22. The direction of displacement thus depends on the flank with which the inserted actuator pin 31 cooperates. An actuator pin 31 is assigned to each flank of the first shift groove 27. An abutment element 10 is formed between the actuator pins 31. This extends in the form of a protrusion from a distal end of the actuator dome 32, parallel to the actuator pins 31, in the direction of the camshaft 20, in particular the carrier shaft 21 of the camshaft 20. The abutment element 10, for at least part of the time, makes contact with the locking element 19, in particular-depending on switch position-a right or left flank of the locking element 19, in order to absorb axial forces of the secondary sliding cam elements 23, 24 actively connected via the adjustment element 40.

The adjustment element 40 is arranged parallel to the carrier shaft 21. The adjustment element 40, which may also be called a pushrod, is axially movable. The adjustment element is offset to the actuator pins 31 by e.g. 90°, in particular by 98°. Alternatively, other angular offsets are conceivable. The adjustment element 40 comprises a first coupling pin 41, a second coupling pin 42 and a third coupling pin 43. The first and third coupling pins 41, 43 are each arranged at an axial end of the adjustment element 40. The coupling pins 41, 42, 43 extend orthogonally to the center longitudinal axis of the carrier shaft 21. The first coupling pin 41 is assigned to the primary sliding cam element 22, in particular the second shift groove 28 of the primary sliding cam element 22, the second coupling pin 42 is assigned to the first secondary sliding cam element 23, and the third coupling pin 43 is assigned to the second secondary sliding cam element 24. If more than two secondary sliding cam elements 23, 24 are arranged on the carrier shaft 21, the adjustment element 40 must have correspondingly more coupling pins. The first coupling pin 41 is permanently in engagement with the second shift groove 28 of the primary sliding cam element 22. The second coupling pin 42 is permanently in engagement with the shift groove 29 of the first secondary sliding cam elements 23, and the third coupling pin 43 is permanently in engagement with the shift groove 29 of the second secondary sliding cam element 24.

The first coupling pin 41 is loaded with a force by a flank of the second shift groove 28. The adjustment element 40 is displaced in the action direction of this force.

The displacement of the adjustment element 40 causes the second coupling pin 42 to move axially in the shift groove 29. More precisely, the second coupling pin 42 is moved towards one of the flanks of the shift groove 29. The second coupling pin 42 cooperates with the shift groove 29 in substantially the same way as the actuator pin 31 cooperates with the first shift groove 27 of the primary sliding cam element 22. The same applies to the third coupling pin 43.

Figure 4:
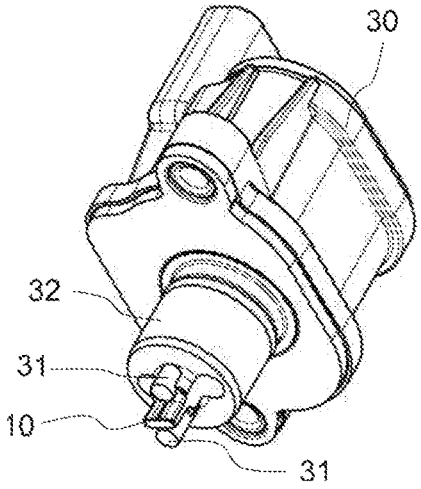
FIG. 4 is a perspective view, an embodiment of an actuator with abutment element from the embodiment of a sliding cam system according to the invention shown in FIG. 3.

FIG. 4 shows a perspective view of an embodiment of an actuator 30 with abutment element 10 in the embodiment of a sliding cam system 1 according to the invention shown in FIG. 3. The abutment element 10 extends between the actuator pins 31, in particular parallel to the actuator pins 31. It is spaced equidistantly from both actuator pins 31 and accordingly is formed centrally between the actuator pins 31. Advantageously, the abutment element 10 has the form of a protrusion. The abutment element 10 has a length which corresponds substantially to the length of an extended actuator pin 31. It is however also conceivable that the abutment element 10 is formed longer or shorter than the actuator pins 31. Viewed in cross-section, it is conceivable that the abutment element 10 has an oval or rectangular form (cross-sectional form). Other deviating forms are however also conceivable. The abutment element 10, similarly to the actuator pins 31, extends away from an end face of the actuator dome 32.

Figure 5:
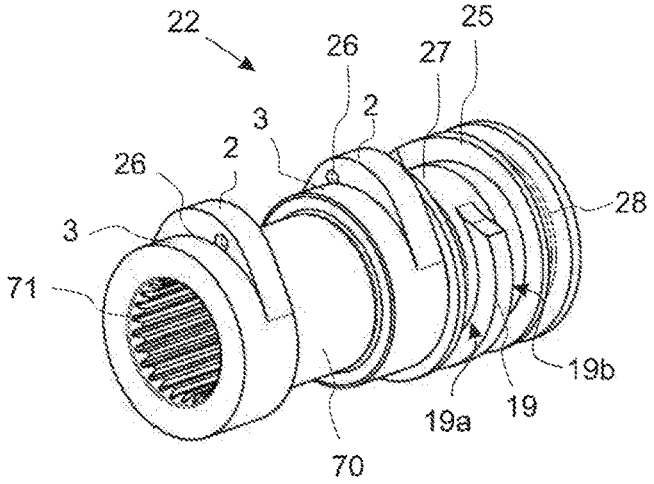
FIG. 5 is a perspective view, an embodiment of a primary sliding cam element from the embodiment of a sliding cam system according to the invention shown in FIG. 3.

FIG. 5 shows a perspective view of an embodiment of a primary sliding cam element 22 of the embodiment of a sliding cam system 1 according to the invention shown in FIG. 3. The primary sliding cam element 22 comprises a sliding sleeve 70 with an inner longitudinal toothing 71 in order to be pushed onto a carrier shaft 21 and its outer longitudinal toothing, as shown in FIG. 3. Cam portions 26, each with an adjustment cam 2 or a lift cam contour 2 and a zero-lift cam 3 or zero-lift cam contour 3, and a shift gate 25 with an X-shaped or V-shaped or Y-shaped first shift groove 27 and an annular second shift groove 28, are also formed. A locking element 19 is formed inside the first shift groove 27 extending at least in portions in the circumferential direction inside the first shift groove 27, and is formed as a protrusion in the form of a circular disc with a cutout, or a semi-circular disc, in particular a part-circular disc, preferably in the form of a protrusion running at least partially in the circumferential direction and extending orthogonally to the carrier shaft 21 or sliding sleeve 79. The locking element 19 has a first or left flank 19*a* and a second or right flank 19*b*. The locking element 19 is not formed continuously in the peripheral direction of the first shift groove 27, but has a cutout or recess, in particular an opening, in particular to allow a displacement of the primary sliding cam element 22 along the longitudinal axis of the carrier shaft 21.

Figure 6:
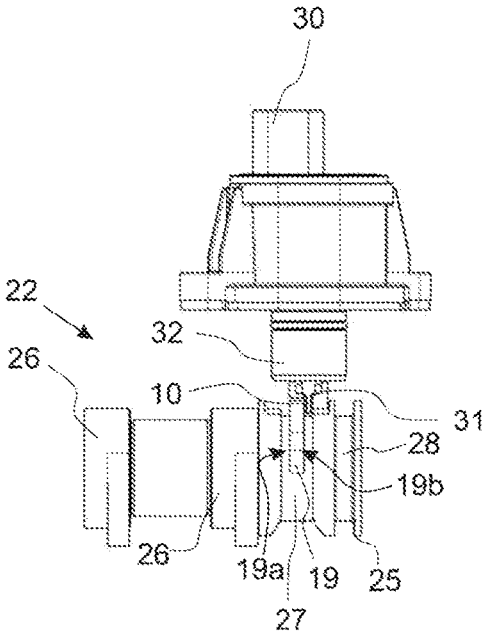
FIG. 6 is a side view, an extract of the embodiment of a sliding cam system according to the invention shown in FIG. 3.

FIG. 6 shows in side view an extract of the embodiment of a sliding cam system 1 according to the invention shown in FIG. 3. As FIG. 6 shows, for receiving axial forces at least between two switchings of the primary sliding cam element 22, the abutment element 10 contacts at least one of the flanks 19*a*, 19*b*, in the present case the second or right flank 19*b*, of the locking element 19 which is formed in the first shift groove 27 of the primary sliding cam element 22. When the right actuator pin 31 is inserted in the first shift groove 27, the primary sliding cam element 22 is moved to the right so that the abutment element 10 creeps along the cutout/opening of the locking element 19 on the side of the first or left flank 19*a* of the locking element 19. Accordingly, on insertion of the left actuator pin 31 in the first shift groove 27, the primary sliding cam element 22 is moved to the left so that the abutment element 10 creeps along the cutout of the locking element 19 on the side of the second or right flank 19*b* of the locking element 19.

Figure 7:
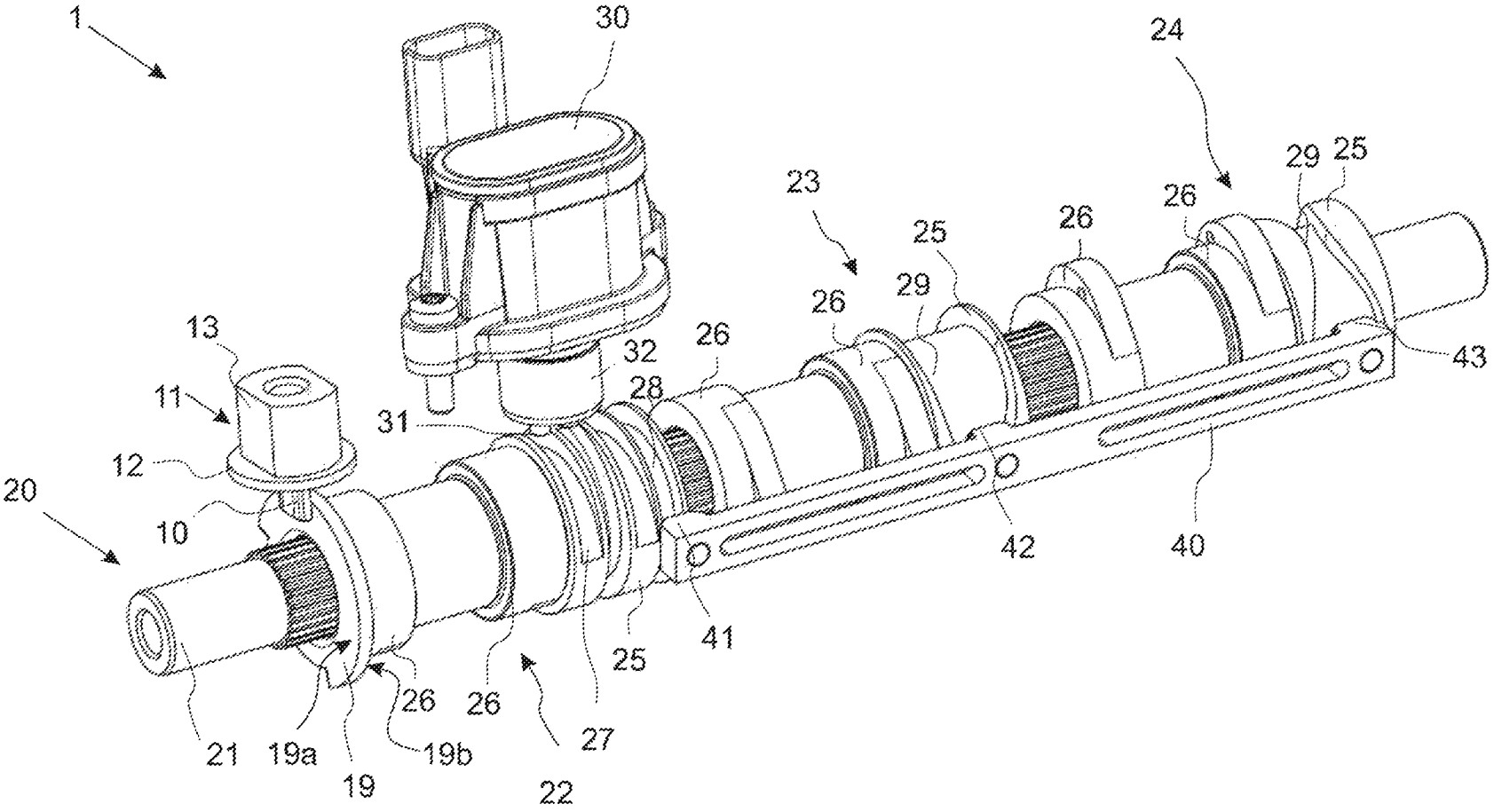
FIG. 7 is a perspective view, a further embodiment of a sliding cam system according to the invention.

FIG. 7 shows a perspective view of a further embodiment of a sliding cam system 1 according to the invention which corresponds substantially, at least with respect to the function method of the sliding cams 22, 23, 24, actuator 30 and adjustment element 40, to the sliding cam system 1 shown in FIG. 3, so the features listed there also apply to the sliding cam system 1 shown in FIG. 6. The embodiment of a sliding cam system 1 according to the invention shown in FIG. 6 also comprises a camshaft 20 with a carrier shaft 21 and sliding cam elements arranged on the carrier shaft 21, in particular a primary sliding cam element 22 and two secondary sliding cam elements 23, 24, which are each arranged axially movably relative to a longitudinal axis of the carrier shaft 21. Each sliding cam element 22, 23, 24 comprises a shift gate 25 and a cam portion 26. The shift gate 25 of the primary sliding cam element 22 comprises a first shift groove 27 and a second shift groove 28. The first shift groove 28 at least in portions is Y-shaped or V-shaped, but may also be S-shaped or X-shaped. The width of the two shift grooves 27, 28 is not the same. The width means the spacing of the flanks of the shift grooves 27, 28 in the axial direction relative to the carrier shaft 21. The flanks of the first shift groove 27 approach one another e.g. in the Y-shaped or V-shaped portion or also in the X-shaped portion. The two shift grooves 27, 28 are arranged at the same rotary angle or are formed with the same rotary angle. The first shift groove 27 at least in portions has a greater radius than the second shift groove 28. A radius here means the distance of the groove base surface of the first or second shift groove 27, 28 from the central longitudinal axis of the carrier shaft 21. Thus the outer diameter of the shift gate 25 and the radius of the groove base surface determine the groove depth. The first shift groove 27 advantageously has a varying radius. This means that the first shift groove 27 in portions has regions with a greater radius and a smaller radius. The change in radius is stepless. The regions are respectively assigned to an inlet region, an outlet region or a displacement region. The second shift groove 28 has a constant radius. The width of the second shift groove 28 is smaller than the width of the first shift groove 27.

The actuator 30 shown in FIG. 7 has two actuator pins 31 which are arranged on the carrier shaft 21 or extend from the actuator 30, in particular the actuator dome 32, towards the carrier shaft 21. The actuator pins 31 are movable substantially only in one direction, orthogonally to the center longitudinal axis of the carrier shaft 21. The actuator pins 31 are assigned to the first shift groove 27 of the primary sliding cam element 22. This means that the actuator pins cooperate only with the first shift groove 27. The actuator pins 31 are spaced apart from one another in the axial direction of the carrier shaft 21. Thus one of the two actuator pins 31 can be introduced into or brought into engagement with the first shift groove 27 of the primary sliding cam element 22, depending on the position of the primary sliding cam element 22. By introduction of the actuator pin 31, an axial movement of the primary sliding cam element 22 can be initiated.

For this, an actuator pin 31 is introduced into the first shift groove 27. Because of the continuous reduction in groove width, the inserted actuator pin 31 cooperates with a flank of the first shift groove 27 of the primary sliding cam element 22. More precisely, the inserted actuator pin 31 loads a flank of the first shift groove 27 with a force directed against the flank. This causes the axial displacement of the primary sliding cam element 22. The direction of the displacement thus depends on the course of the flank with which the inserted actuator pin 31 cooperates. This applies in particular to the use of or design with a V-shaped or Y-shaped shift groove. An actuator pin 31 is assigned to each flank of the first shift groove 27.

An adjustment element 40 is arranged parallel to the carrier shaft 21. The adjustment element 40, which may also be called a pushrod, is axially movable. The adjustment element is offset to the actuator pin 31 by 90°, preferably by 98°. Alternatively, other angular offsets are conceivable. The adjustment element 40 comprises a first coupling pin 41, a second coupling pin 42 and a third coupling pin 43. The first and third coupling pins 41, 43 are each arranged at an axial end of the adjustment element 40. The coupling pins 41, 42, 43 extend orthogonally to the center longitudinal axis of the carrier shaft 21. The first coupling pin 41 is assigned to the second shift groove 28 of the primary sliding cam element 22. The first coupling pin 41 is assigned to the primary sliding cam element 22, the second coupling pin 42 is assigned to the first secondary sliding cam element 23, and the third coupling pin 43 is assigned to the second secondary sliding cam element 24. If more than two secondary sliding cam elements 23, 24 are arranged on the carrier shaft 21, the adjustment element 40 must have correspondingly more coupling pins. The first coupling pin 41 is permanently in engagement with the second shift groove 28 of the first sliding cam element 22. The second coupling pin 42 is permanently in engagement with the shift groove 29 of the first secondary sliding cam element 23, and the third coupling pin 43 is permanently in engagement with the shift groove 29 of the second secondary sliding cam element 24.

The first coupling pin 41 is loaded with a force by a flank of the second shift groove 28. The adjustment element 40 is moved in the action direction of the force.

The displacement of the adjustment element 40 moves the second coupling pin 42 and consequently also the third coupling pin 43 axially in the respective shift groove 29. More precisely, the coupling pins 42, 43 are moved towards one of the flanks of the respective shift groove 29 of the second secondary sliding cam element 23 or third secondary sliding cam element 24. The second coupling pin 42 cooperates with the shift groove 29 substantially in the same way as the actuator pins 31 cooperate with the first shift groove 27 of the primary sliding cam element 22. The same applies to the third coupling pin 43.

Figure 8:
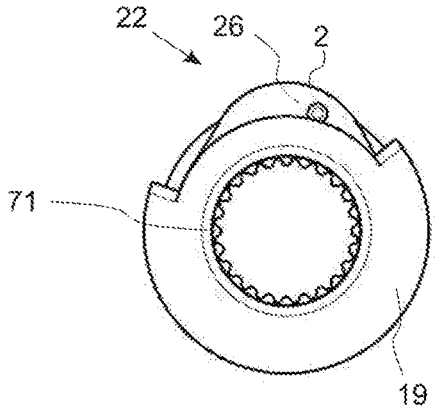
FIG. 8 is a side top view, an embodiment of a primary sliding cam element of the further embodiment of a sliding cam system according to the invention shown in FIG. 7.
Figure 9:
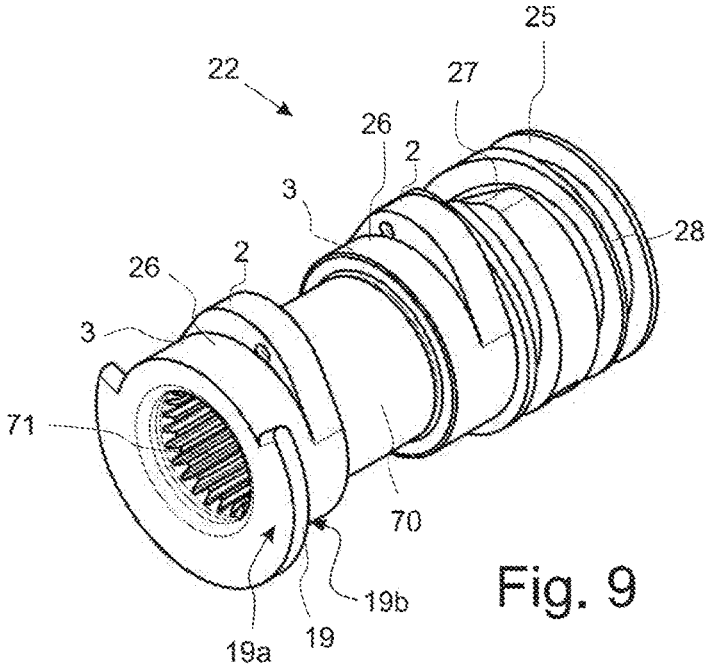
FIG. 9 is a perspective view, the embodiment of a primary sliding cam element shown in FIG. 8.
Figure 10:
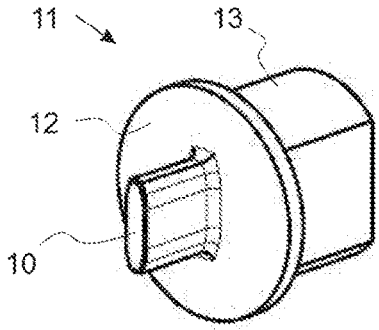
FIG. 10 is a perspective view, an embodiment of an abutment element of the further embodiment of a sliding cam system according to the invention shown in FIG. 7.
Figure 11:
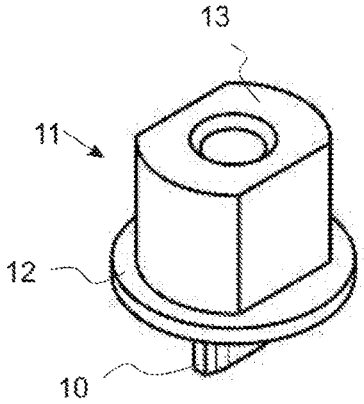
FIG. 11 is a further perspective view, the embodiment of an abutment element shown in FIG. 9.

A locking element 19 is formed for example at an axial end of the primary sliding cam element 22, and advantageously has the form of a circular disc with a cutout/recess/opening, or a semi-circular disc, in particular a part-circular disc. Preferably the cutout takes the form of a protrusion running at least partially in the circumferential direction and extending orthogonally to the carrier shaft 21 or sliding sleeve 79. This is illustrated in FIGS. 8 and 9. The cutout of the circular disc or locking element is formed at a rotary angle of the circular disc such that, on an axial position change of the primary sliding cam element 22, the circular disc or locking element 19 does not collide with an abutment element 10, as will be described below. The locking element 19 has a first or left flank 19*a* and a second or right flank 19*b*. These flanks 19*a*, 19*b* are at least partially (alternately) contacted by an abutment element 10 during operation of the sliding cam system 1. The abutment element 10 extends in the form of a protrusion from a holding element 11, as shown in FIGS. 10 and 11, viewed in the radial direction relative to the longitudinal axis of the carrier shaft 21, in the direction of the camshaft 20, in particular in the direction of the carrier shaft 21 of the camshaft 20. The holding element 11, shown in different perspective views in FIGS. 10 and 11, may also be part of the abutment element 10. It is however also conceivable that the holding element 11 is a separate component on which the abutment element 10 is arranged or fixed. Advantageously, the abutment element 10 extends in the form of a protrusion starting from a positioning disc 12 of the holding element 11. A fixing housing 13 serves to fix the holding element 11 and consequently the abutment element 10 relative to the rotatable and axially displaceable locking element 19. By means of this fixing housing 13, the holding element 11 and accordingly the abutment element 10 are arranged e.g. on a bearing bridge (not shown here) of a cylinder head or on a cylinder head cover etc., in particular on a component which is static relative to the camshaft 20. The function method of the locking element 19 in interaction with the abutment element 10 corresponds to the function method explained with reference to FIG. 3, so in this respect, reference is made to the explanations for FIG. 3. Alternatively, it is conceivable that the abutment element 10 is formed as a protrusion/projection etc., starting from a bearing bridge of the cylinder head cover, in particular as part of the bearing bridge, or is molded on the bearing bridge. Or it is possible that the abutment element 10 is formed as part of the cylinder head cover and extends from this as a corresponding protrusion in the direction of the carrier shaft 21.

FIGS. 8 and 9 each show a different view of an embodiment of a primary sliding cam element 22 of the further embodiment of a sliding cam system 1 according to the invention shown in FIG. 7. The primary sliding cam element 22 comprises a sliding sleeve 70 with an inner longitudinal toothing 71 so that it can be pushed onto a carrier shaft 21 and its outer longitudinal toothing, as shown in FIG. 7. Cam portions 26 each with an adjustment cam 2 or a lift cam contour 2 and a zero-lift cam 3 or zero-lift cam contour 3, and a shift gate 25 with a first X-shaped or S-shaped or Y-shaped or V-shaped shift groove 27 and an annular second shift groove 28, are also formed. A locking element 19, in the form of a (semi-) circular disc, in particular a part-circular disc, is arranged at an axial end of the sliding sleeve 70 or primary sliding cam element 22. The cutout or opening of the circular disc or locking element 19 is formed at a rotary angle of the circular disc at which the protrusions of the adjustment cam 2 or lift cam contours 2 are formed. Advantageously, the cutout or opening of the (semi-) circular locking element 19 is formed at the rotary angle of the (semi-) circular disc such that, on an axial position change of the primary sliding cam element 22, the (semi-) circular disc or flanks 19*a*, 19*b* of the (semi-) circular locking element 19 do not collide with the abutment element 10.

LIST OF REFERENCE SIGNS

1 Sliding cam system
2 Adjustment cam/lift cam contour
3 Zero-lift cam/zero-lift cam contour
10 Abutment element
11 Holding element
12 Positioning disc
13 Fixing housing
19 Locking element
19*a* First/left flank
19*b* Second/right flank
20 Camshaft
21 Carrier shaft
22 Primary sliding cam element
23 (First) secondary sliding cam element
24 (Second) secondary sliding cam element
25 Shift gate
26 Cam portion
27 First shift groove of primary sliding cam element
28 Second shift groove of primary sliding cam element
29 Shift groove of secondary sliding cam element
30 Actuator
31 Actuator pin
32 Actuator dome
40 Adjustment element
41 Coupling pin
42 Coupling pin
43 Coupling pin
(44 Pushrod)
50 Roller bearing
51 Retaining ring
60 Receiving element
70 Sliding sleeve
71 Inner longitudinal toothing

What is claimed is:

1. A sliding cam system for an internal combustion engine, the sliding cam system comprising:

at least one camshaft, an adjustment element and at least one actuator, wherein the at least one camshaft comprises a carrier shaft with a primary sliding cam element and at least one secondary sliding cam element, each of which is arranged so as to be displaceable axially relative to the carrier shaft and each comprises a shift gate with at least one shift groove, and wherein the at least one actuator has at least one actuator pin which engages in the at least one shift groove of the shift gate of the primary sliding cam element according to the necessary switch position of the at least one camshaft, and wherein the adjustment element is arranged parallel to a longitudinal axis of the carrier shaft and is axially displaceable in the direction of the longitudinal axis of the carrier shaft and has at least two coupling pins, wherein a first coupling pin of the at least two coupling pins is arranged in the region of the primary sliding cam element and a second coupling pin of the at least two coupling pins is arranged in the region of the at least one secondary sliding cam element and the first and second coupling pins cooperate with the shift gate of the respective primary and at least one secondary sliding cam elements such that the adjustment element transmits a movement of the primary sliding cam element initiated by the at least one actuator pin to the at least one secondary sliding cam element, wherein a locking element on the primary sliding cam element is configured at least for locking the adjustment element between at least two position changes such that the locking element is displaceable axially along the longitudinal axis of the carrier shaft, the locking element formed inside the at least one shift groove, and at least one abutment element is formed in contact with the locking element and configured to be non-displaceable and rotationally fixed relative to and radially spaced from the carrier shaft at least for receiving axial forces transmitted by the locking element;

wherein the at least one abutment element is formed on the at least one actuator axially next to the at least one actuator pin;

wherein the locking element is in the form of one of a circular disc and ring disc having a cutout defined therein that permits movement of the abutment element through the cutout.

2. The sliding cam system as claimed in claim 1, wherein the at least one abutment element is formed one of directly and indirectly on one of a cylinder head cover and cylinder head.

3. The sliding cam system as claimed in claim 1 wherein the at least one actuator pin, in the at least one actuator, and the at least two coupling pins, in the adjustment element, are offset in a circumferential direction of the carrier shaft by 90°.

4. The sliding cam system as claimed in claim 3 wherein the shift gate of the primary sliding cam element comprises at least one first shift groove for receiving the at least one actuator pin and at least one second shift groove for receiving the first coupling pin, wherein the locking element is formed in the at least one first shift groove.

5. The sliding cam system as claimed in claim 4, wherein the at least one first shift groove of the primary sliding cam element has at least in portions at least one of an X-shaped, V-shaped and Y-shaped profile.

6. The sliding cam system as claimed in claim 4 wherein the at least one second shift groove is formed at an axial end of the primary sliding cam element next to the at least one first shift groove, as a ring groove extending over the entire periphery of the primary sliding cam element, with a constant radius, wherein the first coupling pin is permanently arranged in the at least one second shift groove such that an axial displacement of the primary sliding cam element can be transmitted directly to the adjustment element.

7. The sliding cam system as claimed in claim 6 wherein the at least one first shift groove of the primary sliding cam element and the at least one shift groove of the at least one secondary sliding cam element are arranged offset to one another at a rotary angle such that the at least one secondary sliding cam element can be displaced in a longitudinal direction of the carrier shaft with a time offset relative to the primary sliding cam element.

8. An internal combustion engine having the sliding cam system as claimed in claim 1.

9. The sliding cam system as claimed in claim 1, wherein the at least one actuator pin comprises two actuator pins and wherein the at least one abutment element is formed on the at least one actuator between the two actuator pins in the form of a protrusion.

10. A sliding cam system for an internal combustion engine, the sliding cam system comprising:

at least one camshaft, an adjustment element and at least one actuator, wherein the at least one camshaft comprises a carrier shaft with a primary sliding cam element and at least one secondary sliding cam element, each of which is arranged so as to be displaceable axially relative to the carrier shaft and each comprises a shift gate with at least one shift groove, and wherein the at least one actuator has at least one actuator pin which engages in the at least one shift groove of the shift gate of the primary sliding cam element according to the necessary switch position of the at least one camshaft, and wherein the adjustment element is arranged parallel to a longitudinal axis of the carrier shaft and is axially displaceable in the direction of the longitudinal axis of the carrier shaft and has at least two coupling pins, wherein a first coupling pin of the at least two coupling pins is arranged in the region of the primary sliding cam element and a second coupling pin of the at least two coupling pins is arranged in the region of the at least one secondary sliding cam element and the first and second coupling pins cooperate with the shift gate of the respective primary and at least one secondary sliding cam elements such that the adjustment element transmits a movement of the primary sliding cam element initiated by the at least one actuator pin to the at least one secondary sliding cam element, wherein a locking element on the primary sliding cam element is configured at least for locking the adjustment element between at least two position changes such that the locking element is displaceable axially along the longitudinal axis of the carrier shaft, and an abutment element formed on the at least one actuator in the form of a protrusion, the abutment element in contact with the locking element and configured to be non-displaceable and rotationally fixed relative to and radially spaced from the carrier shaft at least for receiving axial forces transmitted by the locking element, wherein the at least one actuator pin comprises two actuator pins and wherein the abutment element is formed on the at least one actuator between the two actuator pins.

11. The sliding cam system as claimed in claim 10, wherein the abutment element is formed on the at least one actuator axially next to an actuator pin of the two actuator pins.

12. The sliding cam system as claimed in claim 10 wherein the locking element is formed in the at least one shift groove of the shift gate of the primary sliding cam element in the form of one of a circular disc and ring disc having a cutout/opening.

13. The sliding cam system as claimed in claim 10 wherein the at least one actuator, and the adjustment element, are offset in a circumferential direction of the carrier shaft by 90°.

14. The sliding cam system as claimed in claim 10 wherein the shift gate of the primary sliding cam element comprises a first shift groove for receiving an actuator pin of the two actuator pins and a second shift groove for receiving the first coupling pin, wherein the locking element is formed in the first shift groove.

15. The sliding cam system as claimed in claim 10, wherein the at least one shift groove of the primary sliding cam element has at least in portions at least one of an X-shaped, V-shaped and Y-shaped profile.

16. The sliding cam system as claimed in claim 10 wherein a second shift groove is formed at an axial end of the primary sliding cam element next to a first shift groove, as a ring groove extending over the entire periphery of the primary sliding cam element, with a constant radius, wherein the first coupling pin is permanently arranged in the second shift groove such that an axial displacement of the primary sliding cam element can be transmitted directly to the adjustment element.

17. The sliding cam system as claimed in claim 10 wherein the locking element is formed inside the at least one shift groove.

* * * * *